US005629057A

United States Patent [19]

Wang et al.

[11] Patent Number: 5,629,057

[45] Date of Patent: May 13, 1997

[54] COLLAPSIBLE LIGHTED SKELETAL STRUCTURE

[75] Inventors: Jessica Wang; Dennis Wang, both of Taipei, Taiwan

[73] Assignee: Toyo Electric Manufacturing Co. Ltd., Taipei, Taiwan

[21] Appl. No.: 650,290

[22] Filed: May 20, 1996

[51] Int. Cl.[6] ..... A47G 33/00

[52] U.S. Cl. ..... 428/9; 428/11; 428/12; 428/27; 362/806; 362/122

[58] Field of Search ..... 428/8, 9, 11, 27, 428/17, 23, 12, 7; 362/122, 252, 806

*Primary Examiner*—Alexander Thomas

*Attorney, Agent, or Firm*—Martin Smolowitz

[57] ABSTRACT

A skeletal structure is formed of at least 4 and usually 6–12 curved members, each pivotally connected together at their upper and at their lower ends so as to have a generally spherical shape resembling a pumpkin. The skeletal structure is collapsible so that the curved members are parallel to each other for packaging or storage. A string of miniature electrical lamps can be attached removably to the curved members for providing a decorative appearance to the skeletal structure.

6 Claims, 4 Drawing Sheets

COLLAPSIBLE LIGHTED SKELETAL STRUCTURE

BACKGROUND OF THE INVENTION

This invention pertains to collapsible skeletal structures which can have an opened spherical shape and be collapsed for packaging. It pertains particularly to such a skeletal spherical-shaped structure with multiple lamps attached to the skeletal form to decoratively outline the structure.

Various collapsible skeletal structures are known, the structures being collapsible for packaging or storage purposes but are expanded or extended during normal use. One example of such structure are extendible gates and support structures which utilize numerous scissor type members which are pivotably attached together at their ends and mid points. However, the present invention utilizes numerous curved pivoted members in a unique combination to create a collapsible skeletal structure such as having a generally spherical shape.

SUMMARY OF THE INVENTION

It is an object of this invention to provide a decorative skeletal structure which has multiple curved members and is collapsible for packaging and storage.

It is a further object of this invention to provide such a skeletal spherical-shaped structure which has decorative electrical lamps removably attached to it.

The present invention provides a collapsible skeletal structure which is constructed of at least 4 and usually 6–12 curved members which are hinged together at each end to an adjacent curved member, so as to form a structure which is symmetrical about a central major axis which is usually vertical. The skeletal structure can have a ratio of height to diameter between about 0.5/1 and 3/1, but is preferably generally spherical-shaped. The skeletal structure includes one primary curved member which is rigidly attached at its upper and lower ends to a hub element, which element has radial spokes which are in equal number to and in alignment with the curved members. The curved members are each pivotably attached at each end to its adjacent curved member through dual angled spur elements, and are retained in an expanded structure by suitable connection means.

The skeletal structure which is preferably spherical shaped can be collapsed by rotating the curved members at their pivoted end joints so that the curved members are located parallel to each other for packaging or storage.

A string of miniature electrical lamps is preferably removably attached to each of the curved members so as to provide an overall decorative appearance.

This invention advantageously provides a decorative skeletal structure which has the shape of a surface of revolution. The structure can have any desired familiar form, such as an apple, orange, pear or pumpkin shape, and is outlined by a string of miniature electrical lamps having an appropriate color. The skeletal structure is constructed so as to be collapsible for packaging and storage.

BRIEF DESCRIPTION OF THE DRAWINGS

This invention will be described further by reference to the following drawings, in which.

DESCRIPTION OF INVENTION

Figure 1:
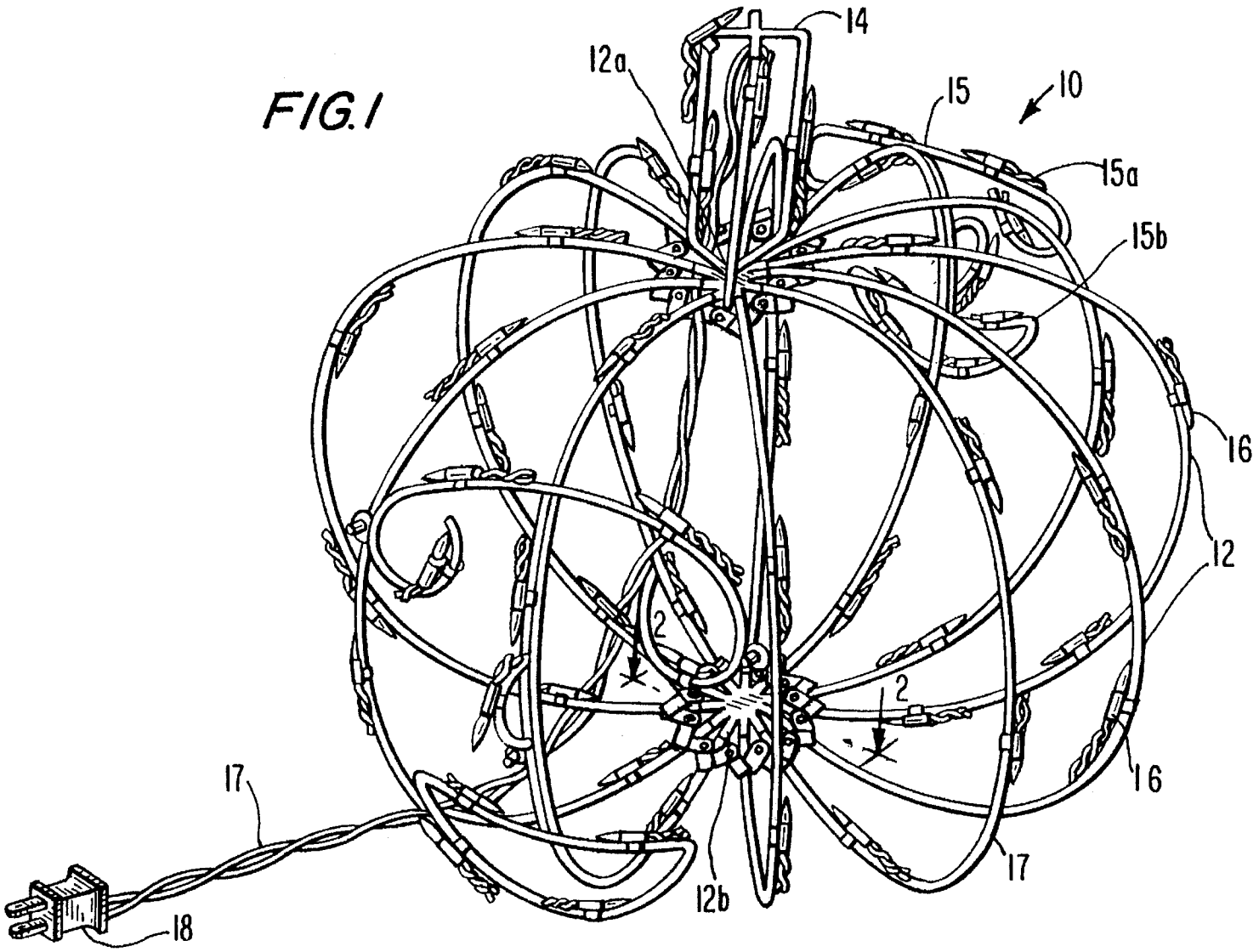
FIG. 1 is a perspective view showing a skeletal spherical-shaped structure which includes many curved members which are generally equally-spaced apart and are pivotably connected together at each end according to the invention; and having multiple electrical lamps attached to the curved members.

As generally shown by FIG. 1, a skeletal spherical-shaped structure 10 is formed by at least four and preferably 6–12 curved members 12; which are each generally equally-spaced apart. The members 12 are pivotably connected together at their respective upper ends 12*a* and lower ends 12*b* to an adjacent member, so as to form a structure which is symmetrical about a central vertical axis and is preferably spherical-shaped so as to resemble a pumpkin. For such a pumpkin shape, a cylindrical-shaped piece 14 is provided pivotably attached to the upper ends 12*a* of the curved members 12, so as to resemble a stem of the pumpkin. Also, if desired, an additional shaped structure 15 having the shape of two eyes 15*a* and a curved mouth 15*b* is provided preferably attached onto the outer surfaces of three adjacent curved members 12 by pins 13 inserted into eyelets 13*a*.

A string of small electrical lamps 16 are removably attached onto the curved members 12 such as by clips 16*a* in a spaced apart pattern along the curved members. The lamps 16 are connected together in a string by dual electrically insulated wires 17, which are all connected to a plug 18 adapted for being plugged into any convenient electrical socket (not shown). The electrical lamps 16 can be similarly employed to those disclosed in applicant's co-pending U.S. patent application, Lamp Holder Having Lockable Cap With Integral Clamping Elements, which is incorporated herein by reference.

Figure 2:
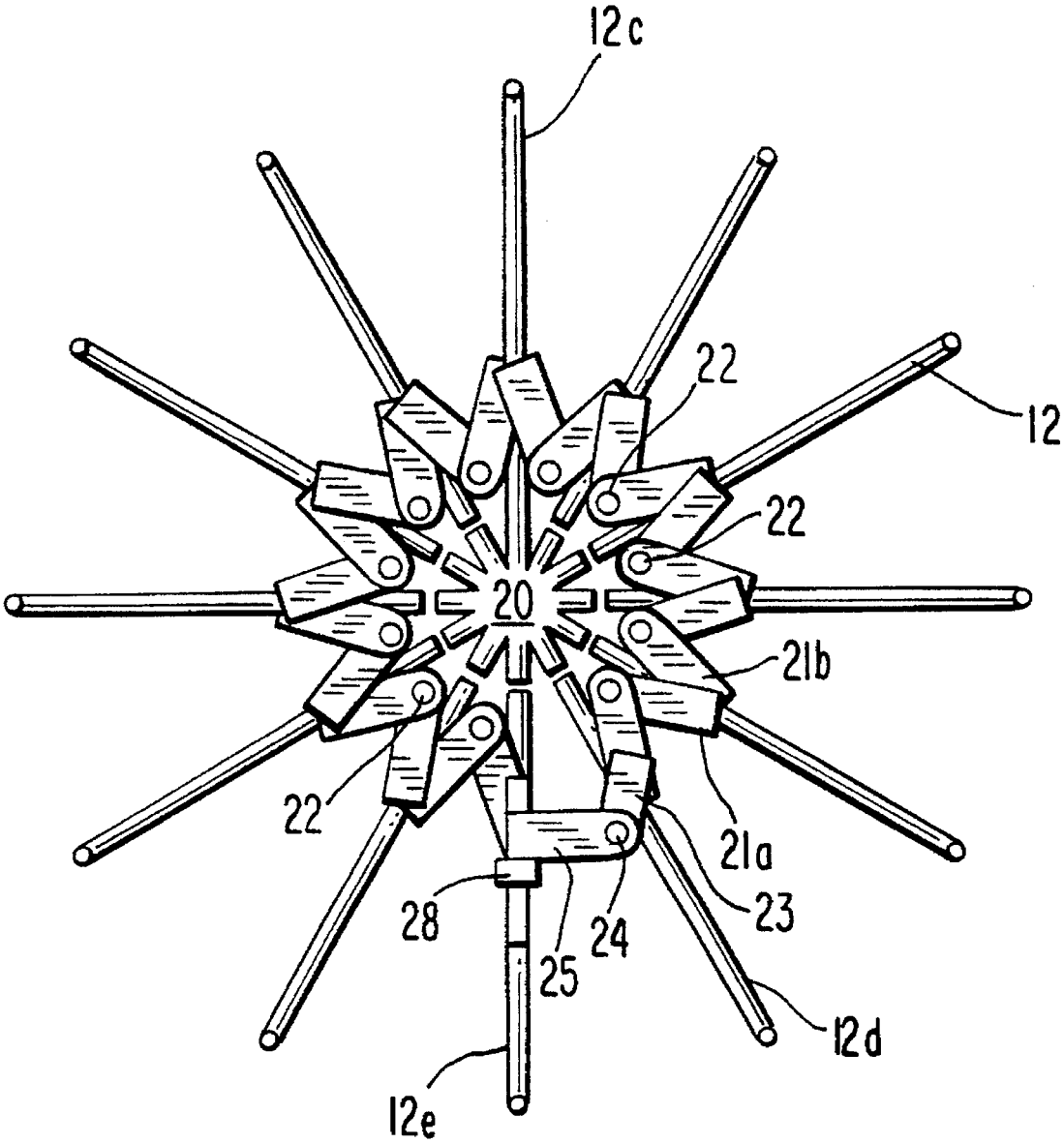
FIG. 2 shows an enlarged sectional plan view taken at line 2—2 of the FIG. 1 lower portion, but without the electrical lamps.

As shown by the sectional FIG. 2 drawing, a primary curved member 12*c* has its lower end rigidly attached to a hub or spider member 20. The spider 20 has a plurality of spokes 20*a* extending radially outwardly and which are provided in a number equal to the number of the curved members 12 for the skeletal structure 10. The lower end of each curved member 12 has two spurs elements 21*a* and 21*b* rigidly attached to the member 12 so as to form an included angle A of 30°–45°. Each spur 21*a* and 21*b* is pivotably connected at 22 to the adjacent spur which is attached to the adjacent curved member 12, each of which is aligned with a spoke 20*a* of the spider member 20. Also, two adjacent secondary members 12*d* and 12*e* are located diametrically opposite from the primary-curved member 12*c*. The secondary member 12*d* has a bracket 23 which is pivotally attached at pivot 24 to a link 25. The link 25 has an attached pin 26 which is aligned so that it can be inserted into an opening 27 in bracket 28 fixedly attached to curved member 12*e*. This connection arrangement serves to retain all the curved members 12 substantially equally-spaced apart in a spherical shape such as to resemble an apple or pumpkin.

Figure 3:
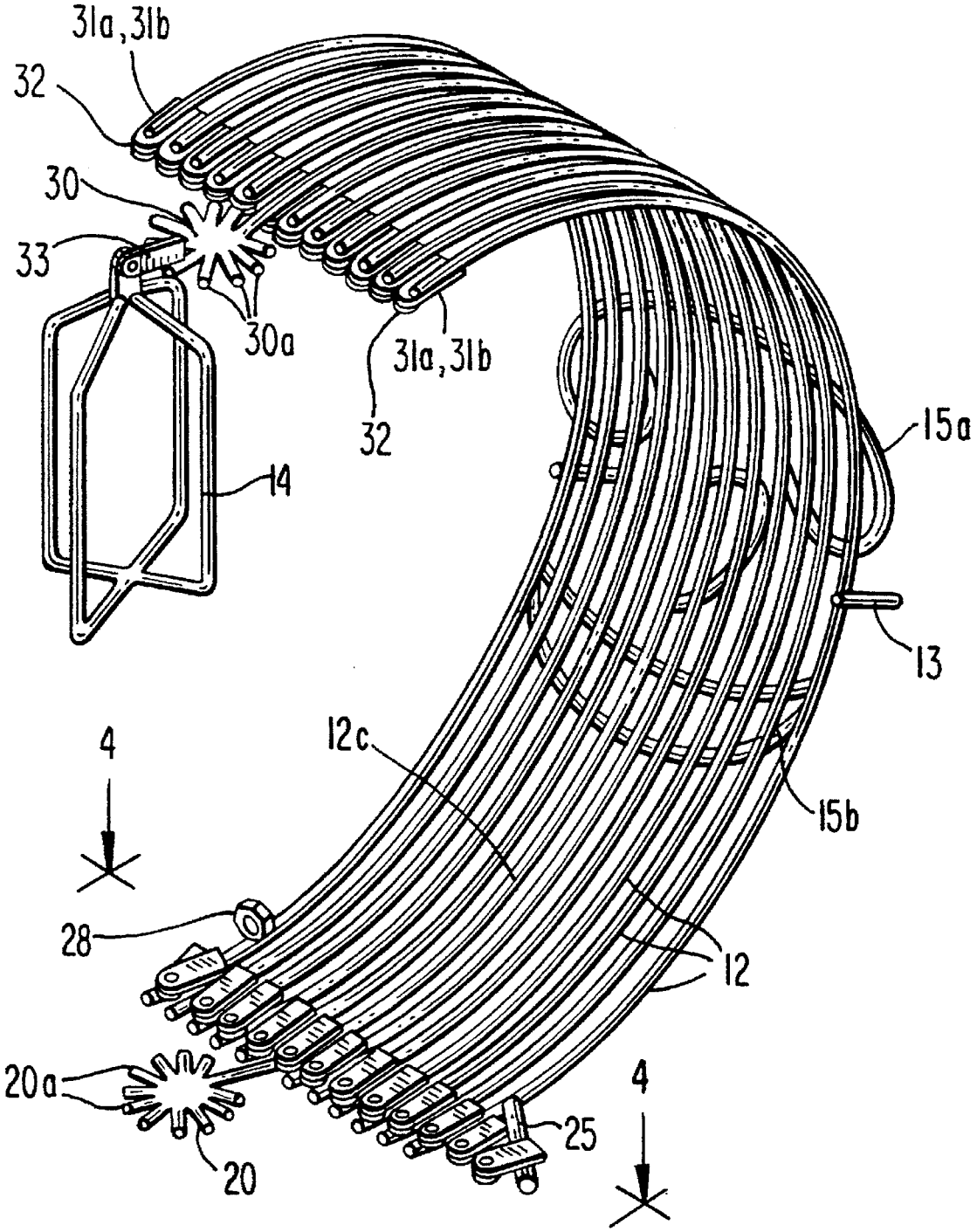
FIG. 3 shows a perspective view of the skeletal structure with the curved members being in a collapsed position.
Figure 4:
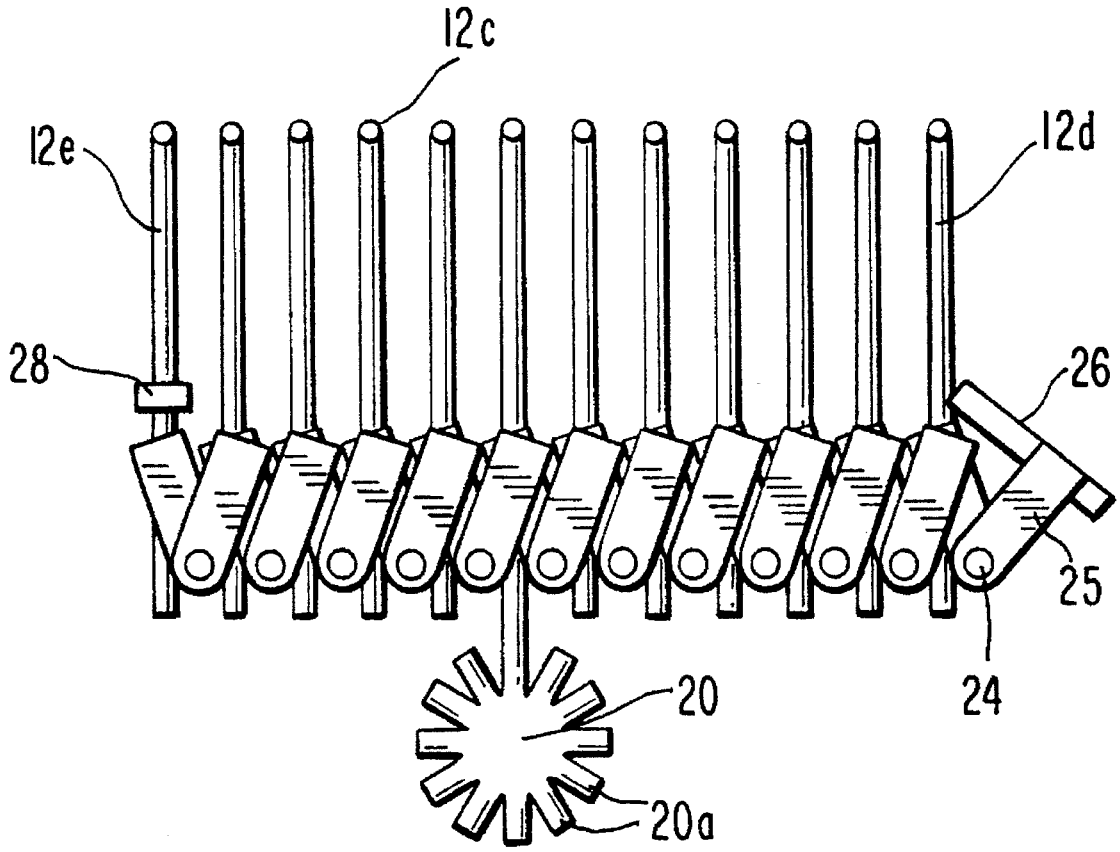
FIG. 4 shows a plan sectional view taken at line 4—4 of FIG. 3.

The skeletal structure 10 can be advantageously collapsed such as for packaging or storage, as shown in FIGS. 3 and 4. Whenever it is desired to collapse the structure 10, the link 25 and pin 26 is unhooked from bracket 28, and the curved members 12 are each swung on their pivots 22 to be in a compact parallel alignment. As specifically shown by FIG. 3, the upper ends 12*a* of the multiple curved members 12 are each provided with two angled spurs 31*a* and 31*b* which are pivotably connected together at 32, as shown in FIG. 2 for the lower end 12*b* of the curved menders 12. The upper end of primary curved member 12*c* is fixedly attached to an upper hub 30 which has multiple spokes 30*a*, similar to the lower hub 20. Thus, the upper hub 30 and lower hub 20 each extend outwardly from the upper and lower ends of the primary curved member 12*c*. The cylindrical shaped stem member 14 is pivotally attached at 33 to the upper hub 30.

The skeletal structure 10 including the curved members 12 and connected parts formed of a relatively rigid material capable of retaining its structural shape. Suitable materials of construction are metals such as aluminum, brass or steel and rigid plastics.

I claim:

1. A collapsible skeletal structure, comprising:

at least four curved members including a primary curved member which can be each positioned about a common central axis, each said curved member having an upper and a lower end;

two hub members one being rigidly attached to the upper end and the other attached to the lower end of said primary curved member, each said hub member having multiple radial spokes each having in alignment with one of said curved members;

each said curved member having two spur elements rigidly attached at its upper end and two spur elements, attached to its lower end, the spur elements at each said end being pivotably attached to the spur elements of the adjacent curved member;

two adjacent secondary curved members each having connection means for connecting the secondary curved members together, whereby the curved members can all be pivoted into a expanded symmetrical shape and then collapsed into a compact shape in which all the curved members are generally parallel to each other.

2. The skeletal structure of claim 1, wherein 6–12 curved members are provided in the structure.

3. The skeletal structure of claim 2, wherein the structure resembles a pumpkin shape and includes a stem member pivotally attached to the upper hub member.

4. The skeletal structure of claim 3, wherein an auxiliary form having the shape of two eyes and a mouth is removably attached to three adjacent curved members.

5. The skeletal structure of claim 1, including a string of electrical lamps removably attached to each said curved member.

6. A collapsible skeletal structure, comprising:

twelve curved members including a primary curved member which can be each positioned about a common central axis, each said curved member having an upper end and a lower end;

two hub members one being rigidly attached to the upper end and the other attached to the lower end of said primary curved member, each said hub member having multiple radial spokes each in alignment with one of said curved members;

each said curved member having two spur elements rigidly attached at its upper end and at its lower end, the spur elements at each said end being pivotably attached to the spur elements of the adjacent curved member;

two adjacent secondary curved members each having pivotable connection means for connecting the secondary curved member together; and a string of electrical lamps removably attached to each curved member, whereby the curved members can all be pivoted into a symmetrical expanded shape and then collapsed into a compact shape in which all the curved members are generally parallel to each other.

* * * * *